US008523603B2

(12) United States Patent
Yamaji et al.

(10) Patent No.: US 8,523,603 B2
(45) Date of Patent: Sep. 3, 2013

(54) CONNECTOR ASSEMBLY

(75) Inventors: Takahiro Yamaji, Tokyo (JP); Akira Kimura, Hirosaki (JP); Kazushi Kamata, Hirosaki (JP); Shuichi Ishida, Hirosaki (JP); Tomomi Sakata, Hirosaki (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 106 days.

(21) Appl. No.: 13/172,089

(22) Filed: Jun. 29, 2011

(65) Prior Publication Data

US 2012/0003857 A1 Jan. 5, 2012

(30) Foreign Application Priority Data

Jun. 30, 2010 (JP) ..... 2010-150448

(51) Int. Cl.
*H01R 12/24* (2006.01)

(52) U.S. Cl.
USPC ..... 439/493

(58) Field of Classification Search
USPC ..... 439/65, 352, 345, 493
See application file for complete search history.

(56) References Cited

U.S. PATENT DOCUMENTS

| | | | | |
|---|---|---|---|---|
| 3,149,896 | A * | 9/1964 | Hall | 439/329 |
| 4,859,189 | A * | 8/1989 | Petersen et al. | 439/66 |
| 6,699,059 | B2 * | 3/2004 | Nagamine et al. | 439/352 |
| 6,953,356 | B2 | 10/2005 | Hisamatsu et al. | |
| 7,377,803 | B2 * | 5/2008 | Matsuoka | 439/497 |
| 7,833,042 | B2 * | 11/2010 | Nishio et al. | 439/331 |
| 7,927,122 | B2 * | 4/2011 | Yamaji et al. | 439/342 |
| 8,043,114 | B2 * | 10/2011 | Kaneko et al. | 439/497 |
| 8,388,370 | B2 * | 3/2013 | Yamaji et al. | 439/497 |
| 2006/0216983 | A1 * | 9/2006 | Langhoff et al. | 439/352 |
| 2010/0291787 | A1 * | 11/2010 | Kuo | 439/352 |

FOREIGN PATENT DOCUMENTS

| | | | |
|---|---|---|---|
| JP | 63-80989 | U | 5/1988 |
| JP | 2000-133378 | A | 5/2000 |
| JP | 2000-215951 | A | 8/2000 |
| JP | 2000-235880 | A | 8/2000 |
| JP | 2003-297482 | A | 10/2003 |

OTHER PUBLICATIONS

Japanese Office Action dated Feb. 23, 2012 (and English translation thereof) in counterpart Japanese Application No. 2010-150448.

* cited by examiner

*Primary Examiner* — Neil Abrams
*Assistant Examiner* — Travis Chambers
(74) *Attorney, Agent, or Firm* — Holtz, Holtz, Goodman & Chick, PC

(57) ABSTRACT

A connector assembly includes a first connector and a second connector. The second connector is engageable with the first connector along a downward direction in a state where the first connector is below the second connector. The second connector includes a second contact, a second holding member and an operating portion. The operating portion is held by the second holding member so that a positional relation therebetween is kept when a force is applied to the operating portion along an upward direction and when a force is applied to the operating portion along a first horizontal direction perpendicular to the upward direction or a second horizontal direction opposite to the first horizontal direction. The second connector is removable from the first connector when a force is applied to the operating portion either along the upward direction or along the first or second horizontal direction.

13 Claims, 16 Drawing Sheets

CONNECTOR ASSEMBLY

CROSS REFERENCE TO RELATED APPLICATIONS

Applicants claim priority under 35 U.S.C. §119 of Japanese Patent Application No. JP2010-150448 filed Jun. 30, 2010.

BACKGROUND OF THE INVENTION

This invention relates to a connector assembly which includes at least two connectors.

For example, a connector assembly including a connector and a mating connector is disclosed in JP-A 2000-215951, contents of which are incorporated herein by reference. The connector of JP-A 2000-215951 has a first member and a second member. The first member is configured to be mounted on a circuit board. The second member is configured to be connected to the mating connector.

The second member has contacts which are brought into contact with contacts of the mating connector when the connector is engaged with the mating connector. The contacts of the second member might be abraded if the connector is engaged with and removed from the mating connector many times. As for the connector of JP-A 2000-215951, only the second member of the connector can be replaced with new one when the contact of the second member is abraded.

It is preferable that connectors of a connector assembly are easily engaged with and removed from each other under a condition that the connectors are frequently engaged with and removed from each other.

SUMMARY OF THE INVENTION

It is therefore an object of the present invention to provide a connector assembly including at least two connectors which are configured to be connected to each other more easily. The connectors of the connector assembly according to the present invention are engaged with and removed from each other with enhanced operability.

One aspect of the present invention provides a connector assembly comprising a first connector and a second connector. The first connector is configured to be mounted on a connection object. The first connector includes a first contact and a first holding member. The first holding member holds the first contact. The second connector is configured to be engaged with the first connector along a downward direction in a state where the first connector is positioned below the second connector. The second connector includes a second contact, a second holding member and an operated portion. The second holding member holds the second contact. The second contact is configured to be connected to the first contact under an engaged state where the second connector is engaged with the first connector. The operating portion is held by the second holding member so that a positional relation between the operating portion and the second holding member is kept when a force is applied to the operating portion along a upward direction and when a force is applied to the operating portion along a first horizontal direction perpendicular to the upward direction or a second horizontal direction opposite to the first horizontal direction. The second connector is removable from the first connector when a force is applied to the operating portion either along the upward direction or along the first horizontal direction or the second horizontal under the engaged state.

An appreciation of the objectives of the present invention and a more complete understanding of its structure may be had by studying the following description of the preferred embodiment and by referring to the accompanying drawings.

Figure 1:
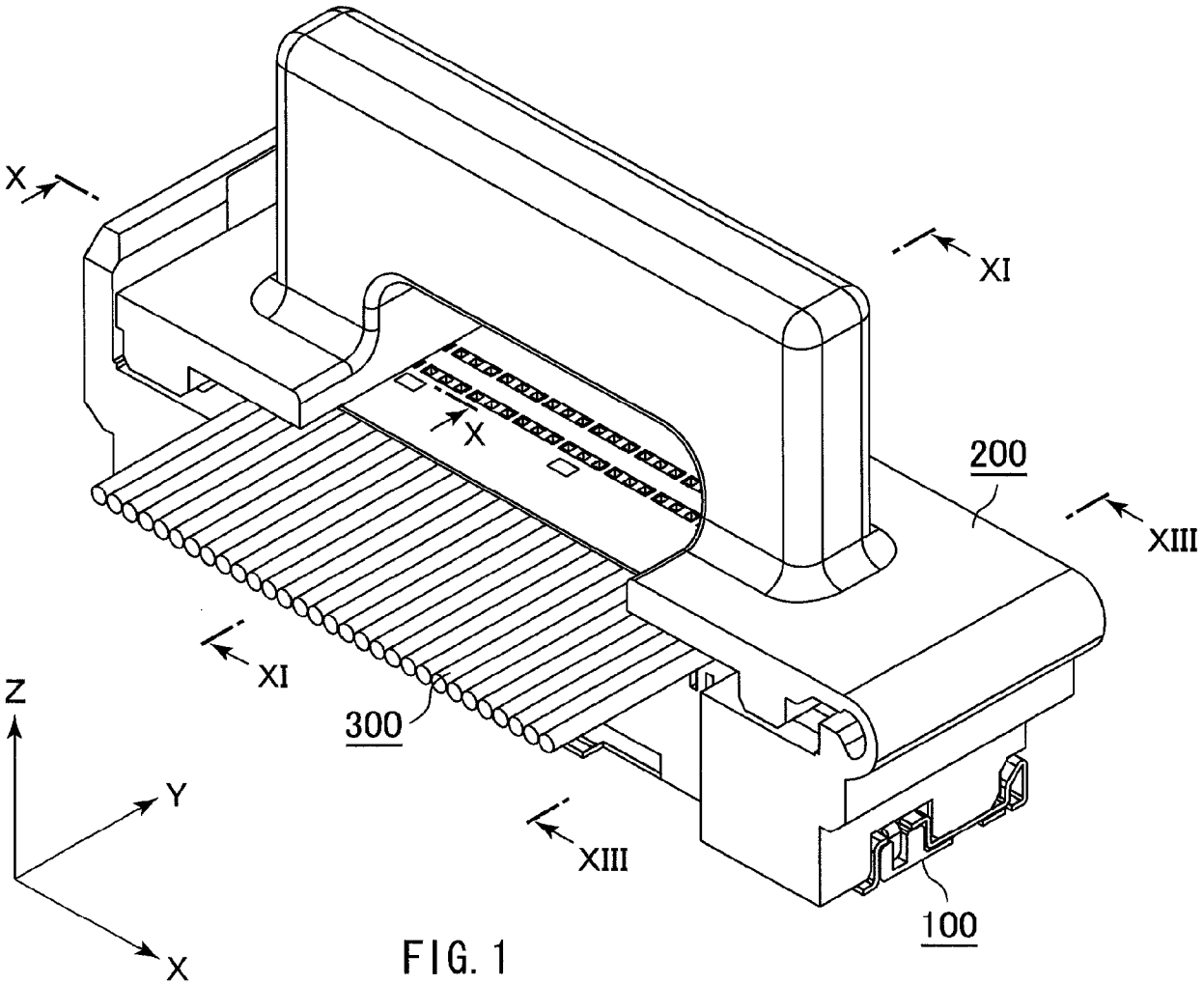
FIG. 1 is a perspective view showing a connector assembly according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

As shown in FIG. 1, a connector assembly according to an embodiment of the present invention comprises a first connector 100, a second connector 200 and a third connector 300. The first connector 100 and the third connector 300 are configured to be engaged with each other (see FIG. 6). Each of the first connector 100 and the third connector 300 has contacts. The contact of the first connector 100 and the contact of the third connector 300 are brought into contact with each other when the first connector 100 and the third connector 300 are engaged with each other. The first connector 100 is configured to be mounted on a connection object (not shown). For example, the connection object is a circuit board. The circuit board on which the first connector 100 is mounted needs to be checked whether the circuit board works properly. The connector assembly according to the present embodiment may be used for a product inspection including the aforementioned check.

In the product inspection of the first connector 100 fixed on the circuit-board, it is necessary to connect the first connector 100 with the third connector 300 electrically. In an existing product inspection, the third connector 300 which was produced as a product similar to the first connector 100 was engaged with the first connector 100 by an engaging operation and was removed from the first connector 100 by a removing operation. Moreover, a common third connector 300 was used in a plurality of the existing product inspections. Therefore, the contacts of the common third connector 300 were abraded in each of the engaging operations and the removing operations so that the third connector 300 needed to be replaced every predetermined number of the product inspections. Therefore, the product inspection cost might increase.

The connector assembly according to the present embodiment has structures described below so that it is possible to connect the first connector 100 with the third connector 300 electrically via the second connector 200. Therefore, it is possible to perform a plurality of the production inspections of the first connectors 100 by engaging each of the first connectors 100 with a common second connector 200 which is kept to be engaged with a common third connector 300. In this case, not the contacts of the common third connector 300 but the contacts of the common second connector 200 are abraded. If the second connector 200 costs lower than the third connector 300, it is possible to reduce the product inspection cost. Moreover, according to the present embodiment, it is possible to make the engaging operation and the removing operation more efficient while keeping the first connector 100 and the second connector 200 to be connected reliably to each other.

Figure 2:
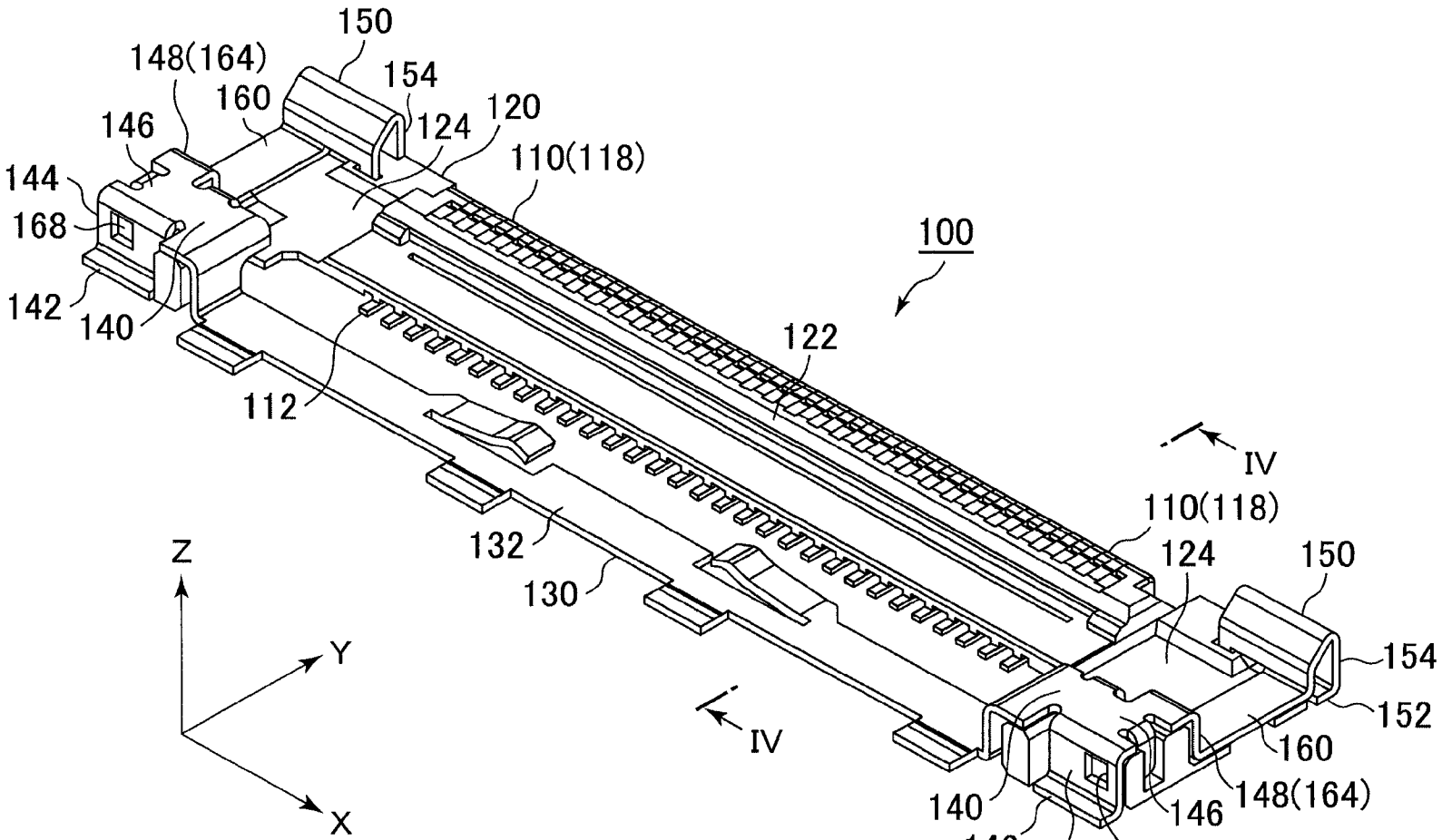
FIG. 2 is a perspective view showing a first connector of the connector assembly of FIG. 1.
Figure 4:
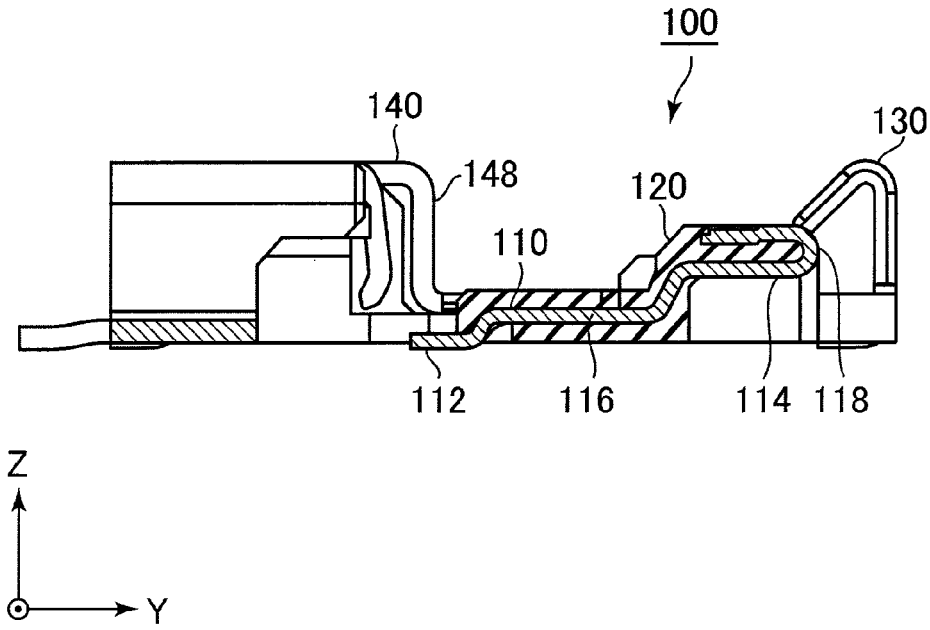
FIG. 4 is a cross-sectional view showing the first connector of FIG. 2, taken along lines IV-IV.

As shown in FIGS. 2 and 4, the first connector 100 includes first contacts 110, a first holding member 120 and a first shell 130.

As shown in FIG. 4, the first contact 110 has an SMT terminal 112, a U-shaped portion 114 and a connecting portion 116. The U-shaped portion 114 is bent so as to have a U-like shape. The connecting portion 116 connects the SMT terminal 112 and the U-shaped portion 114 with each other. The U-shaped portion 114 is formed with a first contact portion 118. The first contact portion 118 is located at a curvature part of the U-shaped portion 114. The first contacts 110 according to the present embodiment are insert-molded so as to be installed in the first holding member 120.

As shown in FIG. 2, the first holding member 120 has a body portion 122 and two side portions 124. The body portion 122 has opposite ends in the X-direction (third horizontal direction). The side portions 124 are formed so as to protrude from the respective ends of the body portion 122 in the negative Y-direction (first horizontal direction). As a whole, the first holding member 120 has a square bracket-like shape. The body portion 122 of the first holding member 120 holds the first contacts 110.

As shown in FIG. 2, the first shell 130 has a body portion 132 and two side portions 140. The body portion 132 has opposite ends in the X-direction. The side portions 140 are formed so as to protrude from the respective ends of the body portion 132 in the positive Y-direction (second horizontal direction). As a whole, the first shell 130 has a square bracket-like shape. The first shell 130 is attached to the first holding member 120. The side portions 140 are positioned so as to overlap the respective side portions 124 of the first holding member 120 in the Z-direction. On the other hand, the body portion 132 is positioned so as not to overlap the first holding member 120 in the Z-direction.

As shown in FIG. 2, each of the side portions 140 of the first shell 130 has a fixed portion 142, a side surface 144, a top surface 146, a side surface 148, a bent portion 150, a fixed portion 152 and a connecting portion 160. The fixed portion 142 is configured to be fixed to the circuit board. The side surface 144 extends upwardly from the fixed portion 142. The top surface 146 extends along the Y-direction from the side surface 144. The side surface 148 extends downwardly from the top surface 146. The bent portion 150 has a side surface 154. The side surface 154 has a lower end in the Z-direction. The fixed portion 152 is formed on the lower end of the side surface 154. The bent portion 150 has another lower end opposite to the lower end of the side surface 154 in the Y-direction. The connecting portion 160 connects the opposite lower end of the bent portion 150 and the side surface 148 with each other.

Figure 3:
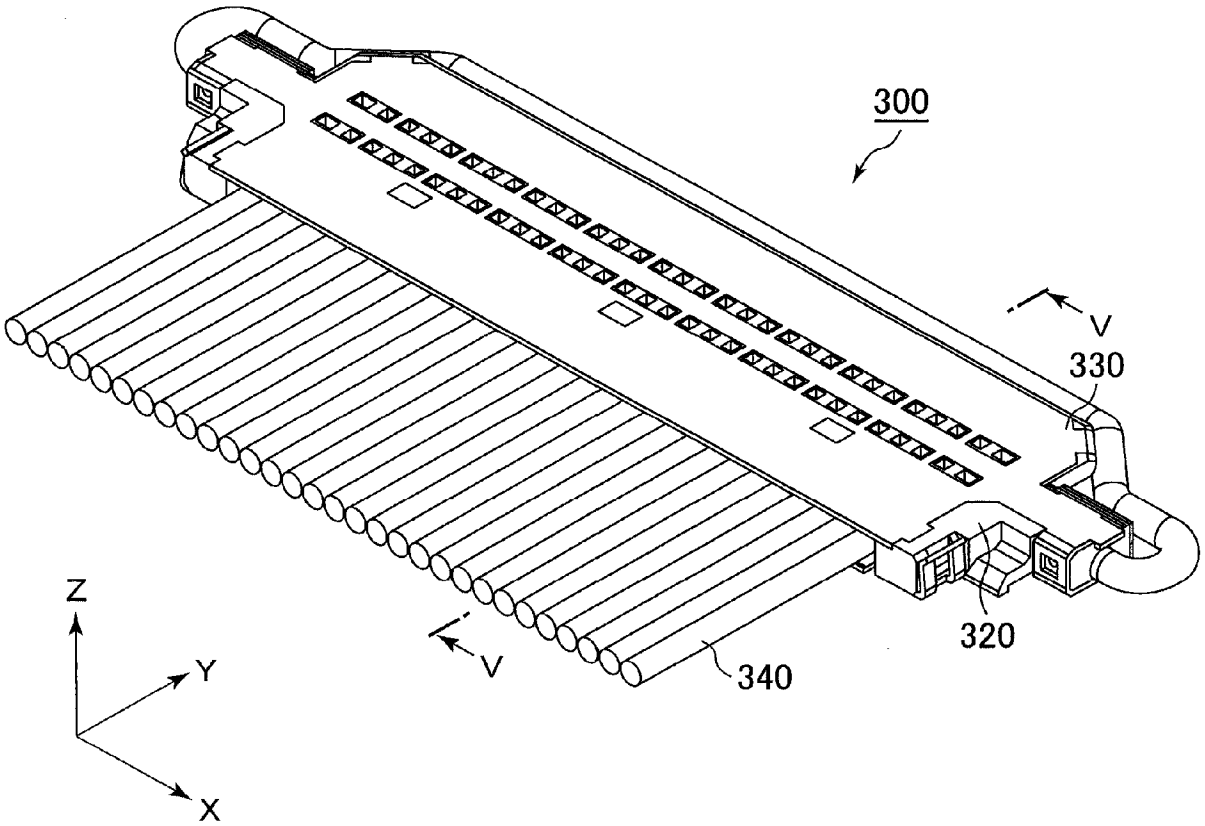
FIG. 3 is a perspective view showing a third connector of the connector assembly of FIG. 1.
Figure 5:
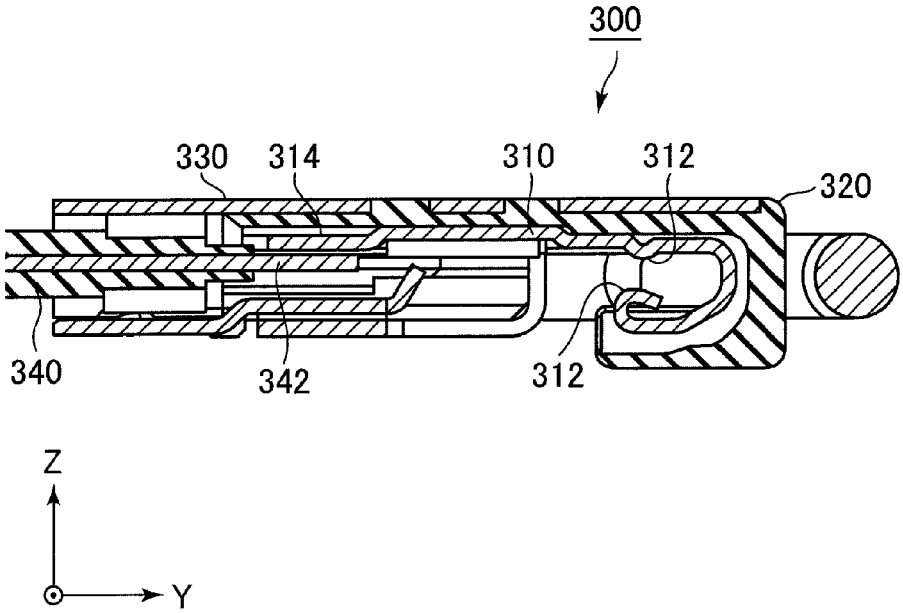
FIG. 5 is a cross-sectional view showing the third connector of FIG. 3, taken along lines V-V.

As shown in FIGS. 3 and 5, the third connector 300 includes third contacts 310, a third holding member 320 and a third shell 330. The third connector 300 is configured to be engaged with the second connector 200. The third connector 300 is also configured so that a cable 340 is connected thereto. The cable 340 has signal lines 342.

Figure 6:
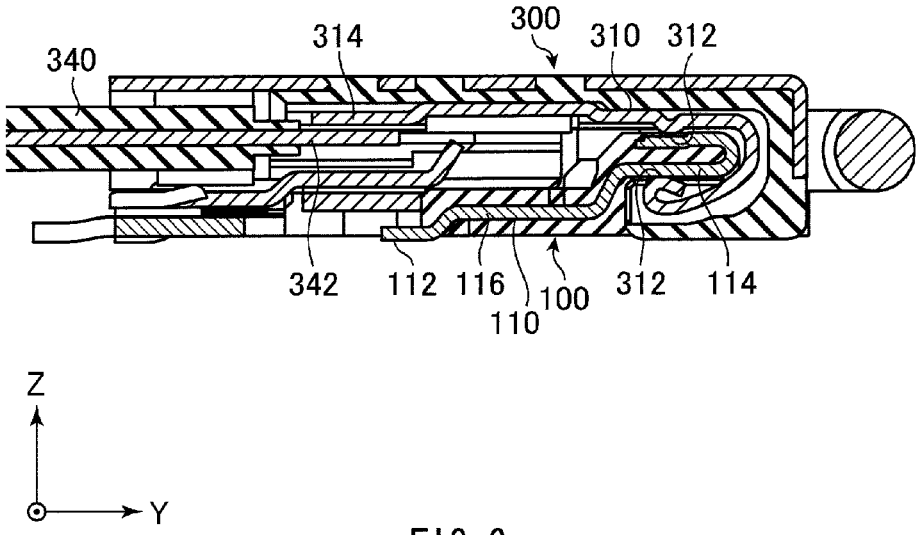
FIG. 6 is a cross-sectional view showing the first connector of FIG. 2 and the third connector of FIG. 3, wherein the first connector and the third connector are engaged with each other.

As shown in FIG. 5, the third contact 310 has a hook-like shape. In detail, the third contact 310 has a bent portion and a linearly extending portion. The bent portion of the third contact 310 is formed with two connect-to-second-connector portions 312. The connect-to-second-connector portions 312 are formed so as to face each other in the Z-direction. The linearly extending portion of the third contact 310 has a connect-to-cable portion 314 formed at an end thereof. The connect-to-cable portion 314 is configured to be connected to the signal line 342 of the cable 340. As shown in FIG. 6, the connect-to-second-connector portions 312 put the U-shaped portion 114 of the first contact 110 therebetween in the Z-direction when the third connector 300 and the first connector 100 are engaged with each other so that the third connector 300 and the first connector 100 are electrically connected to each other. As can be seen from FIGS. 4 to 6, the first connector 100 and the third connector 300 are engaged with each other in a manner described below. At first, the third connector 300 is moved along the Z-direction so as to be placed on the first connector 100. Then, the third connector 300 is moved in the negative Y-direction so that the first contact 110 and the third contact 310 are brought into contact with each other.

Figure 7:
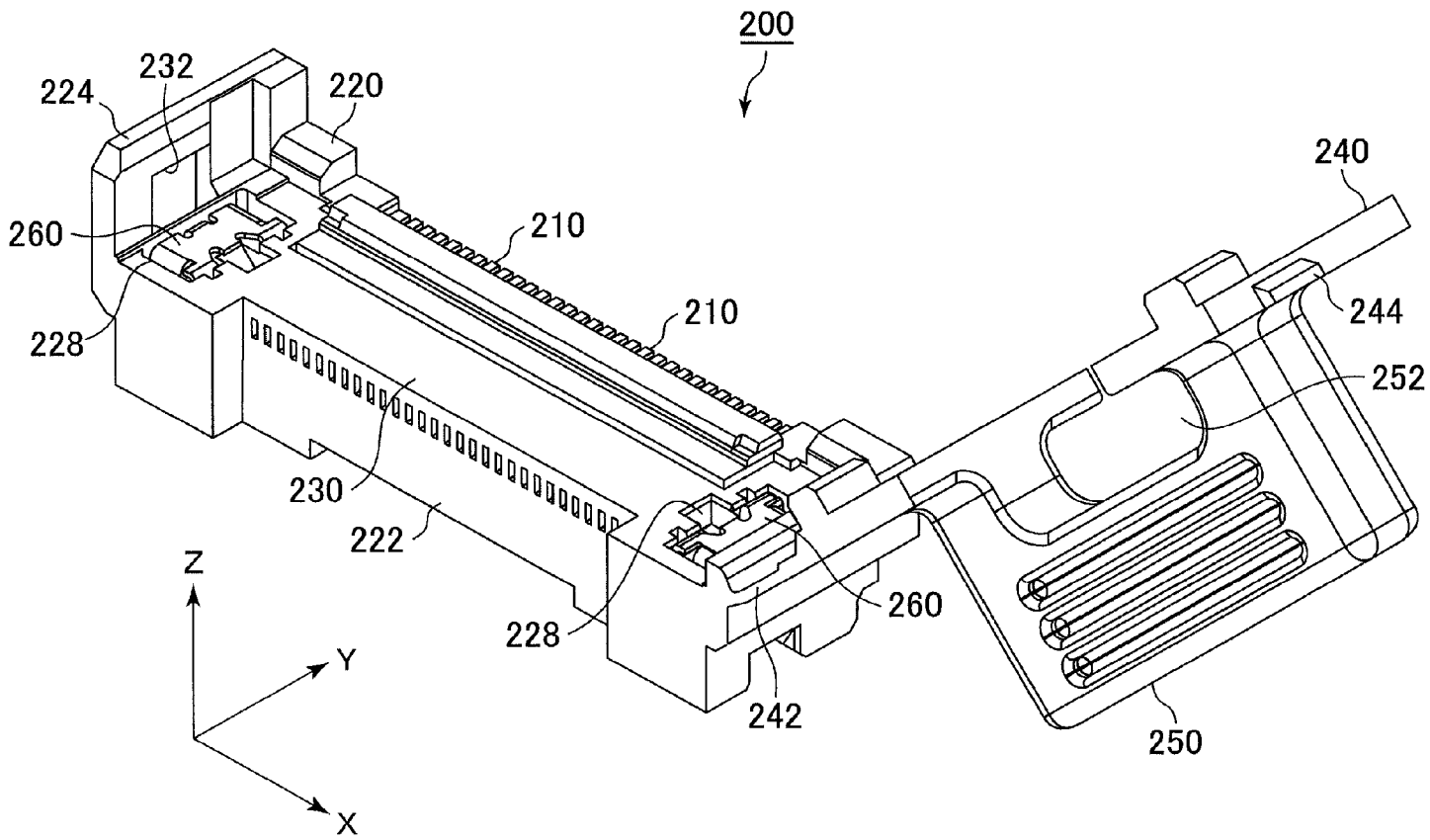
FIG. 7 is a perspective view showing a second connector of the connector assembly of FIG. 1.

As shown in FIG. 7, the second connector 200 includes a plurality of second contacts 210, a second holding member 220, a cover portion 240, an operating portion 250 and a locking member 260. The second connector 200 according to the present embodiment is engageable with both the first connector 100 and third connector 300. In other words, either the first connector 100 or third connector 300 is configured to be engaged with the second connector 200. The second connector 200 is configured to electrically connect the first connector 100 and the third connector 300 with each other.

Figure 8:
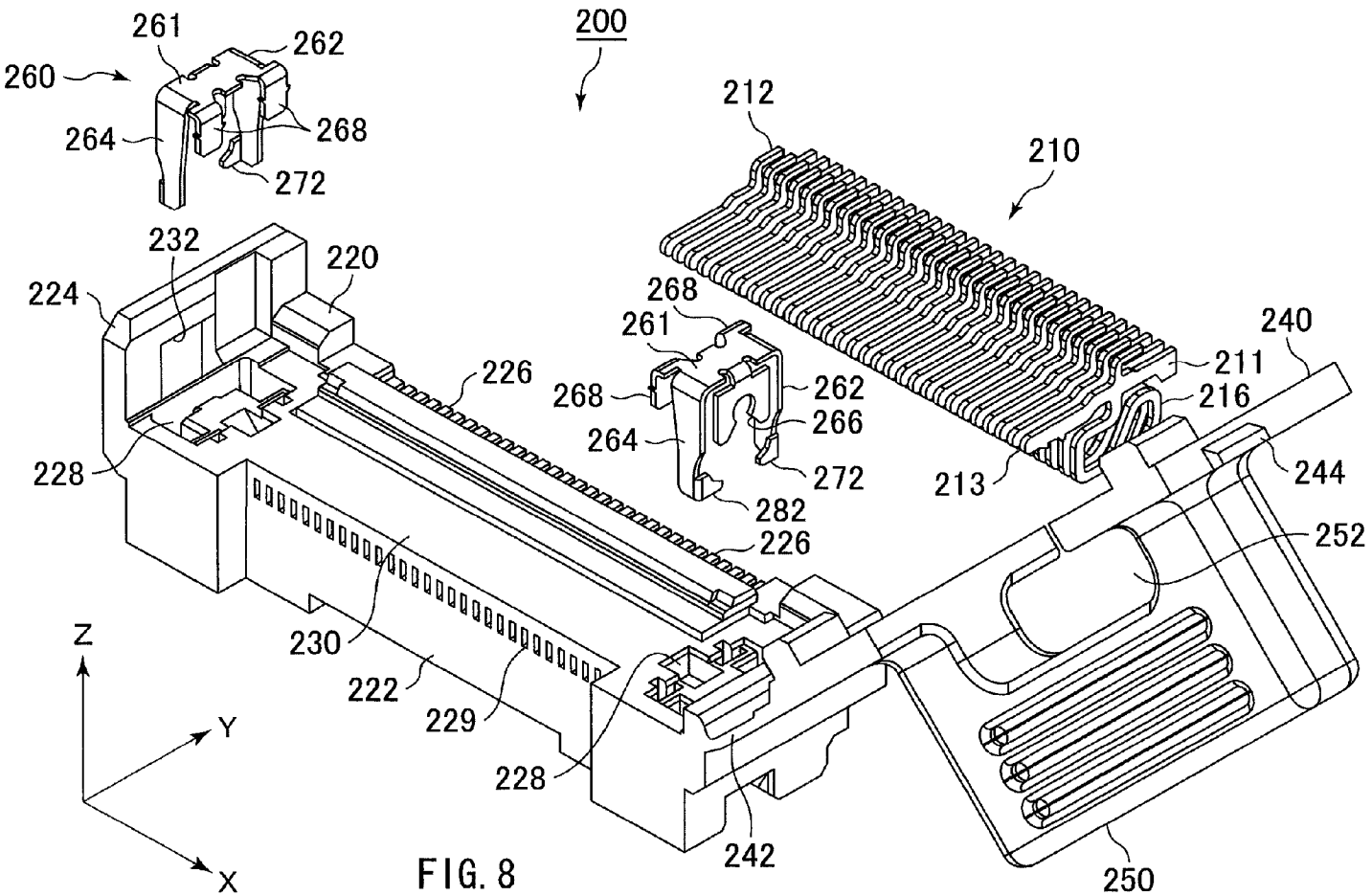
FIG. 8 is an exploded, perspective view showing the second connector of FIG. 7.
Figure 11:
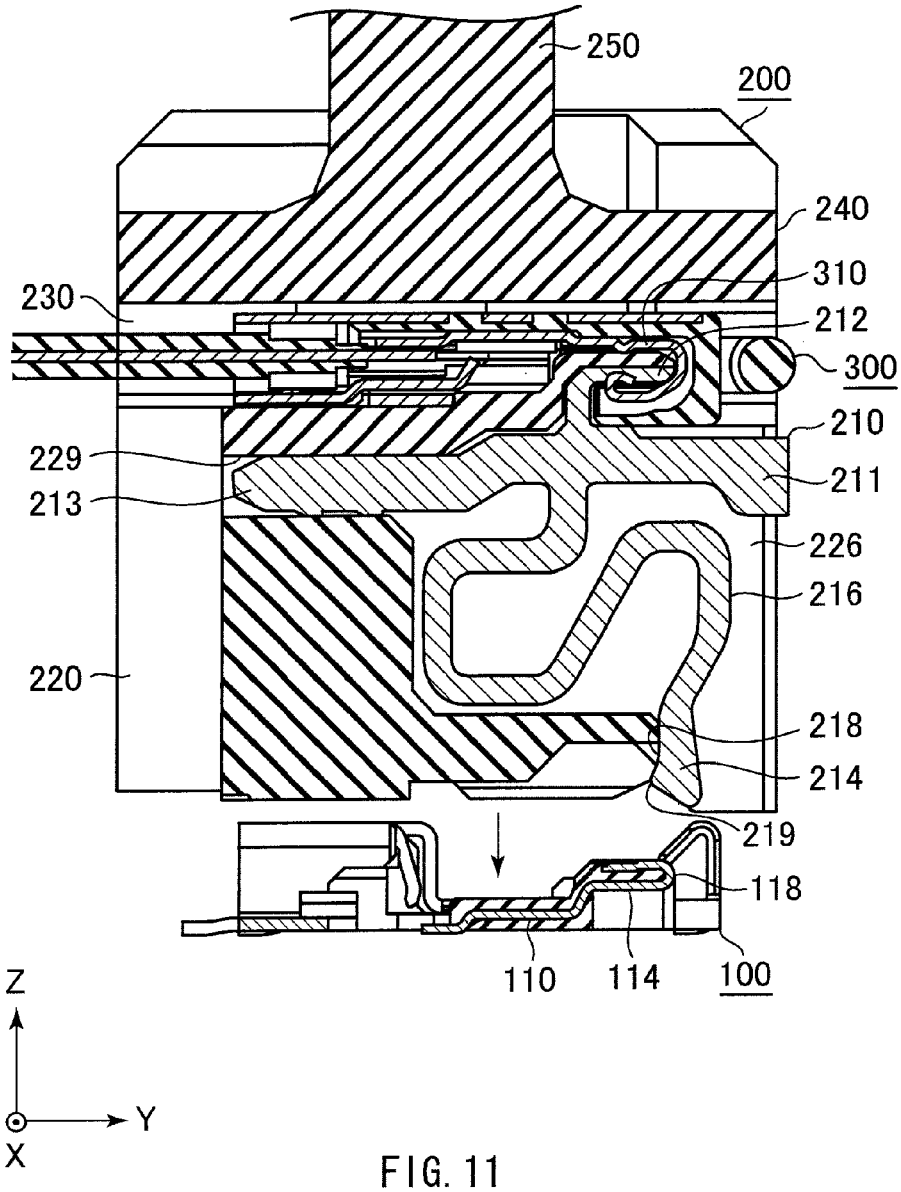
FIG. 11 is a partial, cross-sectional view showing the connector assembly of FIG. 1, taken along lines XI-XI, wherein the first connector and the second connector are not yet engaged with each other.

As shown in FIGS. 8 and 11, the second contact 210 has a body portion 211, a connect-to-third-connector portion 212, a press-fit portion 213, a connect-to-first-connector portion 214 and an elastic support portion 216. The body portion 211 extends in the Y-direction. The connect-to-third-connector portion 212 extends upwardly from the body portion 211 so as to have an L-like shape. The press-fit portion 213 is formed at a tip of the body portion 211 in the negative Y-direction. The elastic support portion 216 is shaped in an S-like shape. The elastic support portion 216 connects the connect-to-first-connector portion 214 and the body portion 211 with each other. The second holding member 220 is formed with a press-fitted portion 229. As described later, the press-fit portion 213 is press-fitted into the press-fitted portion 229 so that the second contact 210 is fixed to and held by the second holding member 220.

As shown in FIG. 11, the connect-to-first-connector portion 214 is formed with a second contact portion 218 and a surmounting portion 219. The surmounting portion 219 is formed below the second contact portion 218 in the Z-direction. The surmounting portion 219 has a protrusion protruding in the negative Y-direction. The protrusion of the surmounting portion 219 is shaped in a wedge-like shape. According to the present embodiment, the connect-to-first-connector portion 214 is formed ahead of the elastic support portion 216 so that the elastic support portion 216 supports both the second contact portion 218 and the surmounting portion 219 of the connect-to-first-connector portion 214 elastically. The elastic support portion 216 has an S-like shape so that the elastic support portion 216 has a long spring-length and flexibility.

As can be seen from FIGS. 11 and 12, the second connector 200 is configured to be engaged with the first connector 100 along the negative Z-direction (downward direction) in a state where the first connector 100 is positioned below the second connector 200. As described below, the second connector 200 is moved toward the first connector 100 so as to be engaged with the first connector 100. At first, the second connector 200 is in a separated state where the second connector 200 is separated from the first connector 100. The second connector 200 in the separated state is moved in the downward direction so as to be located at an engaged position where the second contact portion 218 is brought into contact with the first contact portion 118 of the first connector 100. When the second connector 200 is located at the engaged position, the second connector 200 is in an engaged state where the second connector 200 is engaged with the first connector 100. In other words, the second contact 210 is configured to be connected to the first contact 110 under the engaged state. While the second connector 200 moves from the separated state to the engaged state, the surmounting portion 219 is located below the second contact portion 218 in the negative Z-direction (downward direction) and brought into abutment with the first contact portion 118 of the first connector. The first contact portion 118 pushes the surmounting portion 219 in the positive Y-direction so that the surmounting portion 219 surmounts the first contact portion 118. When the surmounting portion 219 surmounts the first contact portion 118, the second connector 200 reaches the engaged state. The elastic support portion 216 presses the second contact portion 218 against the first contact portion 118 along the negative Y-direction (first horizontal direction) under the engaged state so that the second contact portion 218 is brought into contact with the first contact portion 118 and the second connector 200 is electrically connected to the first connector 100. The surmounting portion 219 is located obliquely bellow the first contact portion 118 (i.e. bellow the first contact portion 118 in the Z-direction) under the engaged state so that the engaged state is maintained.

Figure 12:
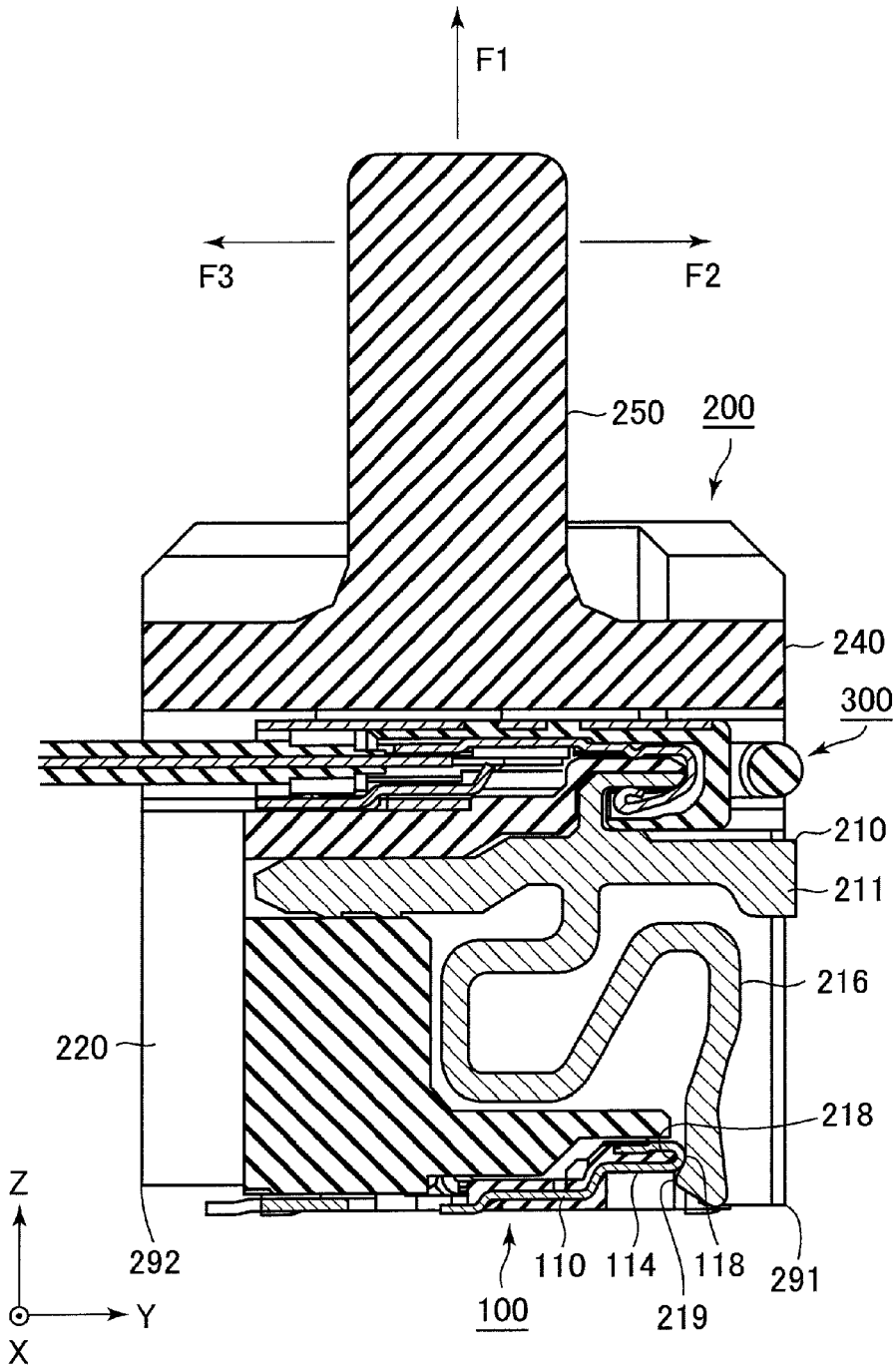
FIG. 12 is a cross-sectional view showing the connector assembly of FIG. 1, taken along lines XI-XI, wherein the first connector and the second connector are in an engaged state.

As can be seen from FIGS. 1, 4 and 12, the second holding member 220 covers the first holding member 120 in the negative Y-direction (first horizontal direction) and the positive Y-direction (second horizontal direction) under the engaged state. As can be seen from FIG. 12, under the engaged state, the second contact portion 218 receives a reaction force along the positive Y-direction from the first contact portion 118 while applying a force along the negative Y-direction to the first contact portion 118. This reaction force is applied to the second connector 200 so that some parts of the second holding member 220 are pressed against parts of the first connector 100, namely, the first holding member 120 and the first shell 130 along the positive Y-direction (second horizontal direction). For example, as can be seen from FIG. 13, a part of the second holding member 220 is pressed against the side surface 144 of the first shell 130. As can be seen from the above description, the first connector 100 receives both a force along the negative Y-direction from the second contact portion 218 and a force along the positive Y-direction from a part of the second holding member 220. In other words, the first connector 100 is put between the forces facing each other so that the engaged state is maintained.

As shown in FIGS. 7 and 8, the second holding member 220 has a body portion 222, a side portion 224 and a connecting portion 242. The body portion 222 has opposite ends in the X-direction. The side portion 224 is formed on one of the end of the body portion 222 and rises along the positive Z-direction. The connecting portion 242 is formed on the other end of the body portion 222 so as to be opposite to the side portion 224 in the X-direction. The body portion 222 has a plurality of accommodate-second-contact portions 226, accommodate-locking-member portions 228, the press-fitted portions 229 (see FIG. 11) and an accommodating portion 230. Each of the accommodate-second-contact portions 226 is configured to accommodate each of the second contacts 210. Each of the accommodate-locking-member portions 228 is configured to accommodate each of the locking members 260. Each of the press-fitted portions 229 is configured so that each of the press-fit portions 213 (see FIG. 11) of the second contact 210 is press-fitted thereinto. The accommodating portion 230 is configured so that the third connector 300 is placed thereon and accommodated therein.

The side portion 224 is formed with a hole which pierces the side portion 224 in the X-direction. The hole has an upper surface formed inside of the hole. As described later, the upper surface of the hole functions as a holding-member-side hooked portion 232.

The cover portion 240 has two end portions in a predetermined direction perpendicular to the negative Y-direction (first horizontal direction). The cover portion 240 is integrally formed with the second holding member 220 and is connected to the connecting portion 242. Specifically, one of the end portions of the cover portion 240 is hinged to the second holding member 220 so that the cover portion 240 is pivotable on the hinged part. The opposite end portion of the cover portion 240 is formed with a cover-side hooked portion 244. The cover-side hooked portion 244 is formed as a protrusion.

Figure 9:
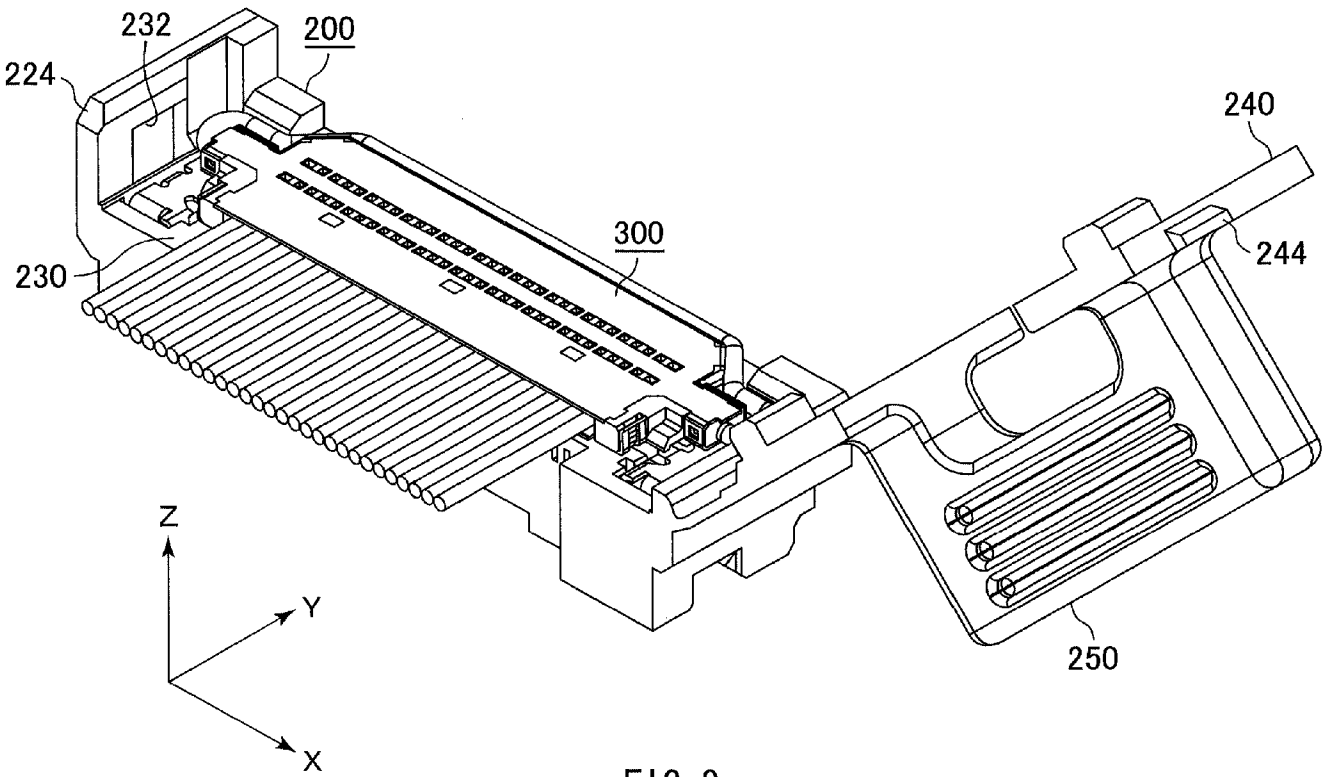
FIG. 9 is a perspective view showing the second connector of FIG. 7 and the third connector of FIG. 3, wherein the third connector is placed on the second connector.
Figure 10:
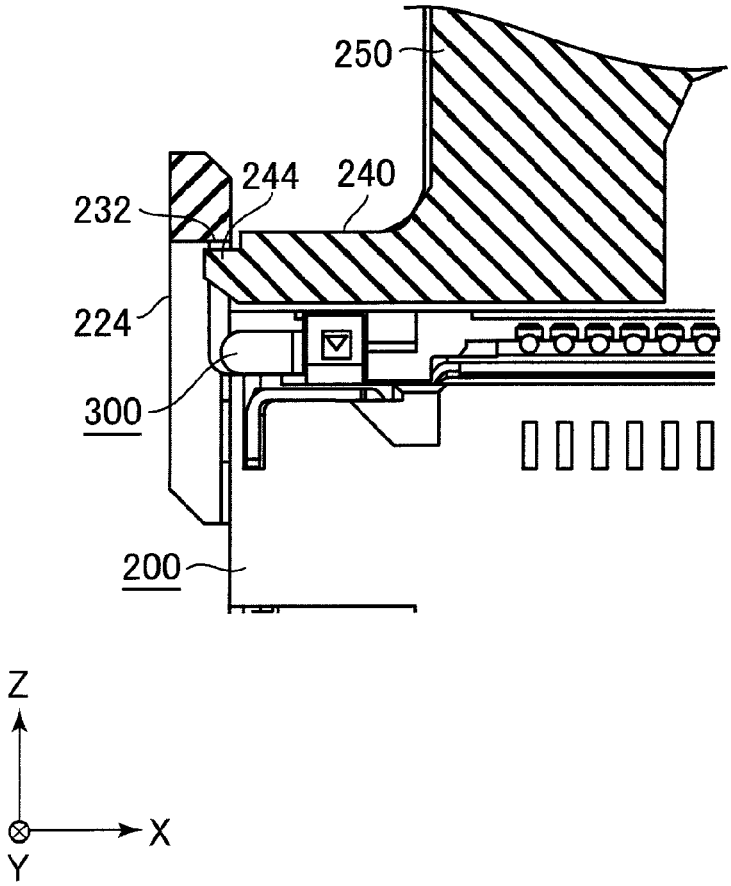
FIG. 10 is a partial, enlarged, cross-sectional view showing about a holding-member-side hooked portion and a cover-side hooked portion of the second connector of FIG. 1, taken along lines X-X.

As shown in FIGS. 1 and 9, the cover portion 240 is configured to pivot on the connecting portion 242 so that the cover portion 240 is openable and closable relative to the second holding member 220. Specifically, the cover portion 240 moves between an opened state where the cover portion 240 rises up from the second holding member 220 and a closed state where the cover portion 240 covers the second holding member 220. As shown in FIG. 9, the third connector 300 is able to be placed on the accommodating portion 230 when the cover portion 240 is in the opened state. As shown in FIG. 1, when the cover portion 240 is turned over the third connector 300 under a state where the third connector 300 is placed on the accommodating portion 230, the cover portion 240 transit to the closed state, the cover portion 240 covers a top surface of the third connector 300 and the third connector 300 is accommodated in the accommodating portion 230. As described above, the cover portion 240 is fixed to the second holding member 220 so that the cover portion 240 is coverable the top surface of the third connector 300 in a state where the third connector 300 is accommodated within the accommodating portion 230. As shown in FIG. 10, the cover-side hooked portion 244 formed on the cover portion 240 and the holding-member-side hooked portion 232 formed in the hole of the side portion 224 of the second holding member 220 are hooked on each other under the closed state so that the cover portion 240 is locked in the closed state. As can be seen from FIGS. 9 and 11, the third connector 300 is configured to be placed on the accommodating portion 230 and engaged with the second connector 200. The third contacts 310 are connected to the second contacts 210 when the third connector 300 is engaged with the second connector 200.

As shown in FIG. 8, the cover portion 240 is formed with an operating portion 250. The operating portion 250 is shaped in a board-like shape so that the operating portion 250 extends both in the positive Z-direction (upward direction) and in the predetermined direction perpendicular to the negative Y-direction. In other words, the cover portion 240 extends in a plane perpendicular to the negative Y-direction (first horizontal direction). The operating portion 250 is formed with a hole 252. The hole 252 is formed on a central region of the operating portion 250 and pierces the operating portion 250 along the negative Y-direction (first horizontal direction). Under the closed state, the cover-side hooked portion 244 is hooked on the holding-member-side hooked portion 232 so that the cover portion 240 is fixed to the second holding member 220. Therefore, a positional relation between the operating portion 250 and the second holding member 220 is not changed even if any force is applied to the operating portion 250 along any direction. In other words, the operating portion 250 is held by the second holding member 220 so that the positional relation between the operating portion 250 and the second holding member 220 is kept when a force is applied to the operating portion 250 along the positive Z-direction (upward direction) and when a force is applied to the operating portion 250 along the negative Y-direction (first horizontal direction) or the positive Y-direction (second horizontal direction). As can be understood from the above description, the operating portion 250 and the second holding member 220 move together with each other under the closed state so that it is possible to move the whole second connector 200 including the second holding member 220 by moving the operating portion 250. The operating portion 250 according to the present embodiment is used to put the cover portion 240 in the opened state or the closed state. Furthermore, as described later, the operating portion 250 is used to force the second connector 200 to be engaged with and removed from the first connector 100. Moreover, the hole 252 is formed on the operating portion 250 so that the operating portion 250 is operated easily, for example, with a tape threading the hole 252.

The cover portion 240 according to the present embodiment is connected with the second holding member 220 by the connecting portion 242 and is formed with the second holding member 220 integrally. However, the cover portion 240 may be formed as a separated member from the second holding member 220 on condition that the cover portion 240 is configured to be fixed to the second holding member 220 under the closed state. According to the present embodiment, the hole 252 pierces not only the operating portion 250 but also the cover portion 240. The hole 252 splits the cover portion 240 in two pieces. Accordingly, the operating portion 250 has a square bracket-like shape. However, the cover portion 240 may be formed continuously and the operating portion 250 may have an O-like shape.

As shown in FIG. 8, the locking member 260 has a top portion 261, a first-hook support portion 262, a second-hook support portion 264 and fixing portions 266 and 268. The top portion 261 extends in parallel with the XY-plane. The first-hook support portion 262 extends in the negative Z-direction (downward direction) from the positive Y-side end of the top portion 261. The second-hook support portion 264 extends in the negative Z-direction from the negative Y-side end of the top portion 261. The fixing portions 266 and 268 extend in the negative Z-direction (downward direction) from opposite ends in the X-direction of the top portion 261, respectively. The fixing portions 266 and 268 are press-fitted into the second holding member 220 so that the locking member 260 is fixed to and held by the second holding member 220 of the second connector 200. The fixing portions 266 and 268 define a positional relation between the locking member 260 and the second holding member 220.

Figure 13:
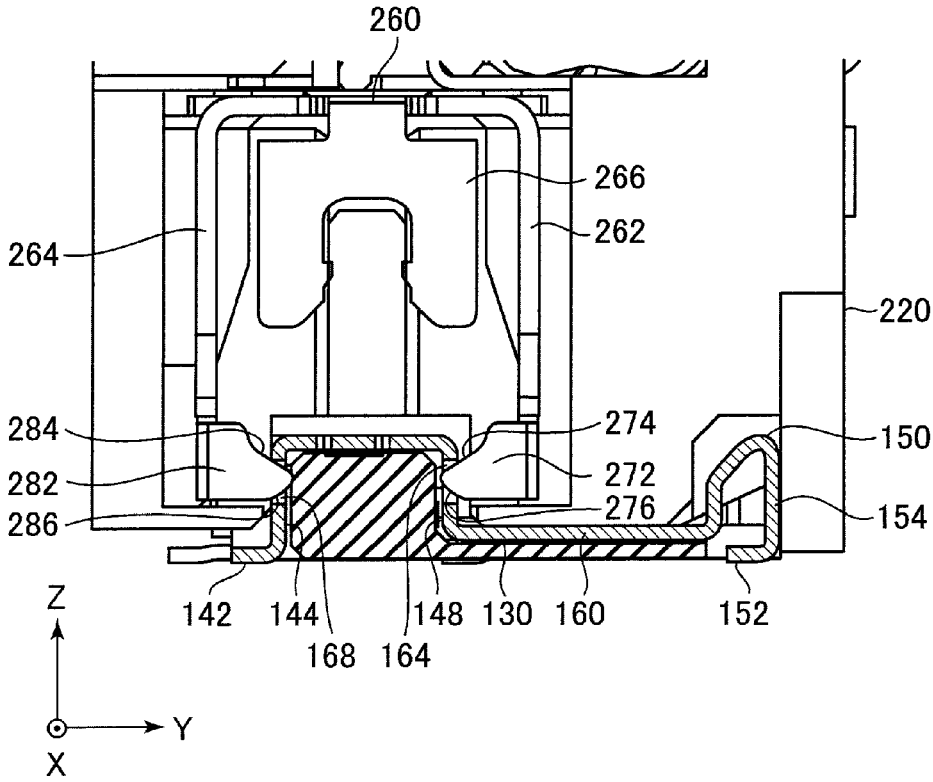
FIG. 13 is a partial, cross-sectional view showing the connector assembly of FIG. 1, taken along lines XIII-XIII.

The first-hook support portion 262 and the second-hook support portion 264 are formed with a first hook portion 272 and a second hook portion 282, respectively. In other words, the locking member 260 of the second connector 200 has two hook portions (i.e. at least one hook portion). The first hook portion 272 and the second hook portion 282 according to the present embodiment protrude in the negative Y-direction (first horizontal direction) and the positive Y-direction (second horizontal direction), respectively. The first hook portion 272 and the second hook portion 282 are held elastically by the first-hook support portion 262 and the second-hook support portion 264, respectively, so as to protrude toward each other. As shown in FIG. 13, the first hook portion 272 has an upper edge 274 and a lower edge 276. The upper edge 274 and the lower edge 276 extend in directions each oblique to the negative Z-direction (downward direction) so that the first hook portion 272 has an acute triangle-like shape, as seen along the X-direction. One of apexes of the acute triangle protrudes in the negative Y-direction. In other words, the upper edge 274 and the lower edge 276 are designed to form a wedge-like shape and to make an angle less than 90 degrees. Similarly, the second hook portion 282 has an upper edge 284 and a lower edge 286. The upper edge 284 and the lower edge 286 extends in directions each oblique to the negative Z-direction so that the second hook portion 282 has an acute triangle-like shape, as seen along the X-direction. One of apexes of the acute triangle protrudes in the positive Y-direction. In other words, the upper edge 284 and the lower edge 286 are designed to form a wedge-like shape and to make an angle less than 90 degrees. The first shell 130 of the first connector 100 is formed with a first hooked portion 164 and a second hooked portion 168. In other words, the first connector 100 has two hooked portions (i.e. at least one hooked portion). As shown in FIG. 13, under the engaged state, the first hook portion 272 and the second hook portion 282 are hooked in the first hooked portion 164 and the second hooked portion 168 of the first shell 130, respectively, so as to put the first shell 130 therebetween. Therefore, the maintenance of the engaged state of the first connector 100 and the second connector 200 is secured. The first-hook support portion 262 and the second-hook support portion 264 are configured to press the first hook portion 272 and the second hook portion 282 against the first hooked portion 164 and the second hooked portion 168 under the engaged state, respectively, so that the maintenance of the engaged state is further secured.

The upper edge 274 of the first hook portion 272 and the upper edge 284 of the second hook portion 282 are designed to extend downwardly. Therefore, as shown in FIG. 12, the second connector 200 in the engaged state is able to be removed from the first connector 100 by applying a force (F1 in FIG. 12) along the positive Z-direction to the operating portion 250. Furthermore, the second connector 200 in the engaged state is able to be removed easily from the first connector 100 by applying a force (F2 in FIG. 12) along the positive Y-direction to the operating portion 250. Specifically, when the force (F2) is applied to the operating portion 250, the second connector 200 pivots on an edge 291 of the second holding member 220 of the second connector 200, and moves in the positive Y-direction, and is removed from the first connector 100. Similarly, when a force (F3 in FIG. 12) along the negative Y-direction is applied to the operating portion 250, the second connector 200 pivots on an edge 292 of the second holding member 220 of the second connector 200, and moves in the negative Y-direction, and is removed from the first connector 100. As described above, the second connector 200 is able to be easily removed from the first connector 100 when a force is applied to the operating portion 250 either along the positive Z-direction (upward direction) or along the negative Y-direction (first horizontal direction) or the positive Y-direction (second horizontal) under the engaged state.

As previously described, the second connector 200 according to the present embodiment is configured to be engaged with the first connector 100 by being moved only in the Z-direction. Therefore, it is possible to make the engaging operation more efficient. Furthermore, when the second connector 200 is in the closed state, the operating portion 250 according to the present embodiment is fixed to and held by the second holding member 220 so that the operating portion 250 does not move relative to the second holding member 220. Thus configured second connector 200 is able to be pulled out of the first connector 100 not only when the operating portion 250 is pulled in the upward direction but also when the operating portion 250 receives a force in the negative Y-direction or the positive Y-direction. More specifically, the second connector 200 is removable from the first connector 100 by pushing down the operating portion 250 frontward along the negative Y-direction or rearward along the positive Y-direction. The second connector 200 is also removable from the first connector 100 by pivoting the operating portion 250 on a fulcrum opposite to a pivoting force across the operating portion 250. Therefore, it is also possible to make the removing operation more efficient. It is possible to perform the product inspection more efficiently by using the connector assembly according to the present embodiment. Moreover, the spirit of the present invention is applicable to other usages than the product inspection.

According to the present embodiment, the second connector 200 functions as an inter-connector which electrically connects the first contact 110 of the first connector 100 and the third contact 310 of the third connector 300 with each other. In other words, the first connector 100 is connected with the third connector 300 through the second connector 200 which costs lower than the third connector 300. In a product inspection of the first connector 100 fixed on a circuit board (not shown), not the third contact 310 of the third connector 300 but the second contact 210 of the second connector 200 may abrade. In the case of abrasion thereof, not the third connector 300 but the second connector 200 is replaced. Thus, the third connector 300 may be used more repeatedly so that it is possible to reduce the cost for the product inspection.

It is shown below various modifications of the locking member according to the present invention.

Figure 14:
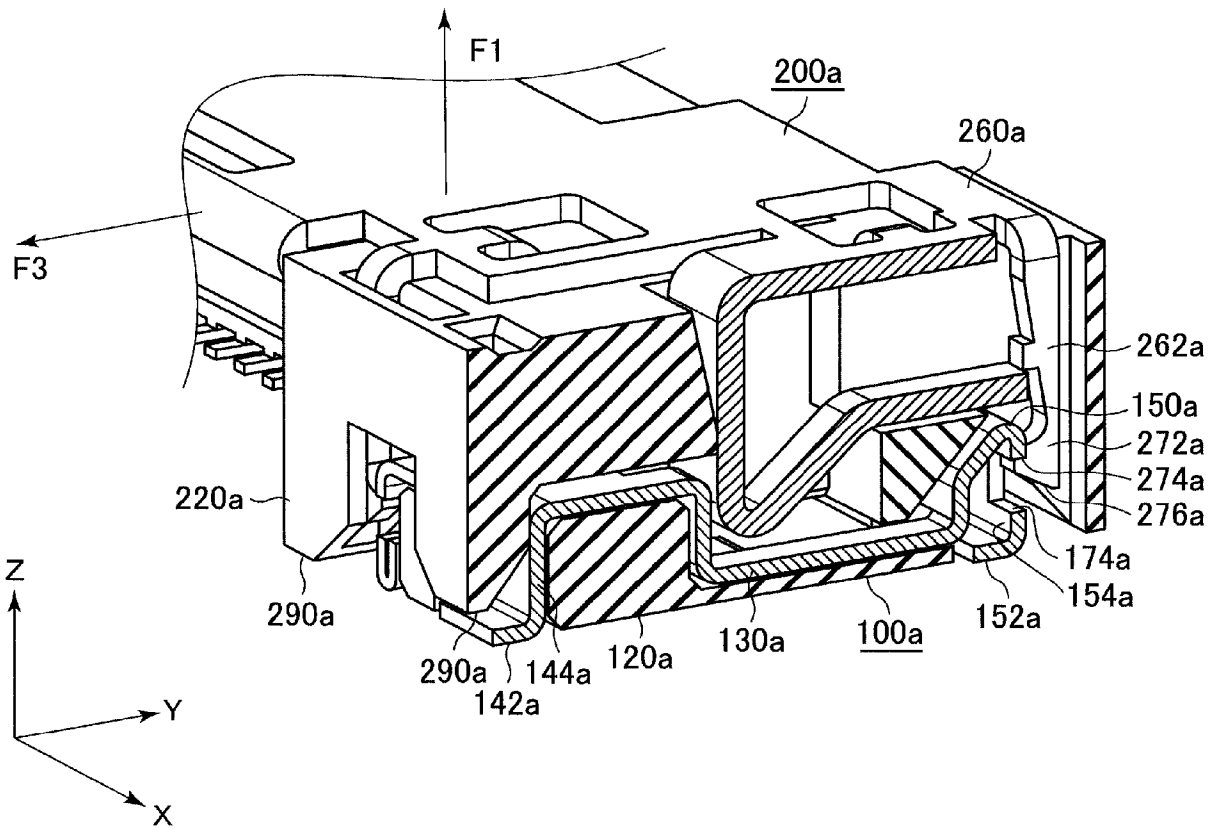
FIG. 14 is a partial, perspective, cross-sectional view showing a locking member and a first shell of a modification of the connector assembly of FIG. 1.

As shown in FIG. 14, a connector assembly according to the present invention may comprise a first connector 100*a* and a second connector 200*a* instead of the first connector 100 and the second connector 200. The first connector 100*a* includes a first shell 130*a*. The first shell 130*a* has a bent portion 150*a* having a side surface 154*a*. The side surface 154*a* is formed with a hooked portion 174*a*. The second connector 200*a* includes a second holding member 220*a* and a locking member 260*a*. The locking member 260*a* has a first-hook support portion 262*a* and a first hook portion 272*a*. The first-hook support portion 262*a* is formed at the positive Y-side end of the second connector 200. The first hook portion 272*a* is configured so that the first hook portion 272*a* is hooked in the hooked portion 174*a* under an engaged state where the first connector 100*a* and the second connector 200*a* are engaged with each other. As can be seen from FIG. 14, under the engaged state, the first hook portion 272*a* receives a reaction force along the positive Y-direction from the first shell 130*a* while applying a force along the negative Y-direction to the first shell 130*a*. The second holding member 220*a* is pressed against a side surface 144*a* of the first shell 130*a* along the positive Y-direction by the reaction force. As can be seen from the above description, the engaged state of the second connector 200*a* with the first connector 100*a* is maintained by the force from the first hook portion 272*a* along the negative Y-direction and the force from the second holding member 220*a* along the positive Y-direction. The first hook portion 272*a* has an upper edge 274*a*. The upper edge 274*a* according to the present embodiment extends in the Y-direction. According to the present embodiment, the removing operation is able to be performed more easily when a force (F3 in FIG. 14) along the negative Y-direction is applied to an operating portion (not shown) of the second connector 200*a* than when a force (F1 in FIG. 14) along the positive Z-direction is applied to the operating portion. Specifically, when the force (F1) is applied to the operating portion, the second connector 200*a* pivots on a lower edge 290*a* located at the negative Y-side of the second holding member 220*a*. The second connector 200*a* is removed from the first connector 100*a* while turning down in the negative Y-direction. On the other hand, when a force along the positive Y-direction is applied to the operating portion, the upper edge 274*a* is brought into abutment with an upper surface of the hooked portion 174*a* so that the second connector 200*a* is prevented from being removed from the first connector 100*a*.

Figure 15:
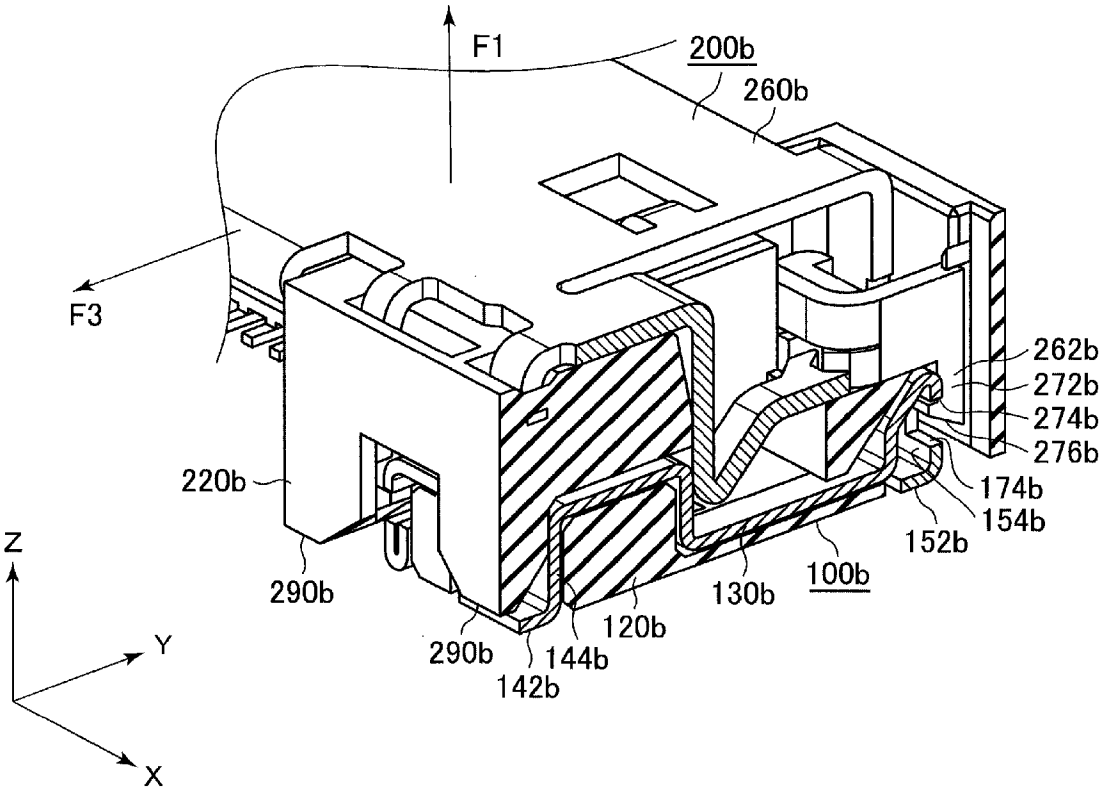
FIG. 15 is a partial, perspective, cross-sectional view showing a locking member and a first shell of another modification of the connector assembly of FIG. 1.

As shown in FIG. 15, a connector assembly may comprise a first connector 100*b* and a second connector 200*b*. The first connector 100*b* includes a first shell 130*b*. The first shell 130*b* is formed with a hooked portion 174*b*. The second connector 200*b* includes a second holding member 220*b* and a locking member 260*b*. The locking member 260*b* has a first hook portion 272*b*. The first hook portion 272*b* is configured so that the first hook portion 272*b* is hooked in the hooked portion 174*b* under an engaged state where the first connector 100*b* and the second connector 200*b* are engaged with each other. The first hook portion 272*b* has an upper edge 274*b*. The upper edge 274*b* according to the present embodiment extends in the Y-direction. According to the present embodiment, the removing operation is able to be performed more easily when a force (F3 in FIG. 15) along the negative Y-direction is applied to an operating portion (not shown) of the second connector 200*b* than when a force (F1 in FIG. 15) along the positive Z-direction is applied to the operating portion. Specifically, when the force (F1) is applied to the operating portion, the second connector 200*b* pivots on a lower edge 290*b* located at the negative Y-side of the second holding member 220*b*. The second connector 200*b* is removed from the first connector 100*b* while turning down in the negative Y-direction. On the other hand, when a force along the positive Y-direction is applied to the operating portion, the upper edge 274*b* is brought into abutment with an upper surface of the hooked portion 174*b* so that the second connector 200*b* is prevented from being removed from the first connector 100*b*. As can be seen from FIG. 15, under the engaged state, the first hook portion 272*b* receive a reaction force along the positive Y-direction from the first shell 130*b* while applying a force along the negative Y-direction to the first shell 130*b*. The second holding member 220*b* is pressed against a side surface 144*b* of the first shell 130*b* along the positive Y-direction by the reaction force. As can be seen from the above description, the engaged state of the second connector 200*b* with the first connector 100*b* is maintained by the force from the first hook portion 272*b* along the negative Y-direction and the force from the second holding member 220*b* along the positive Y-direction.

Figure 16:
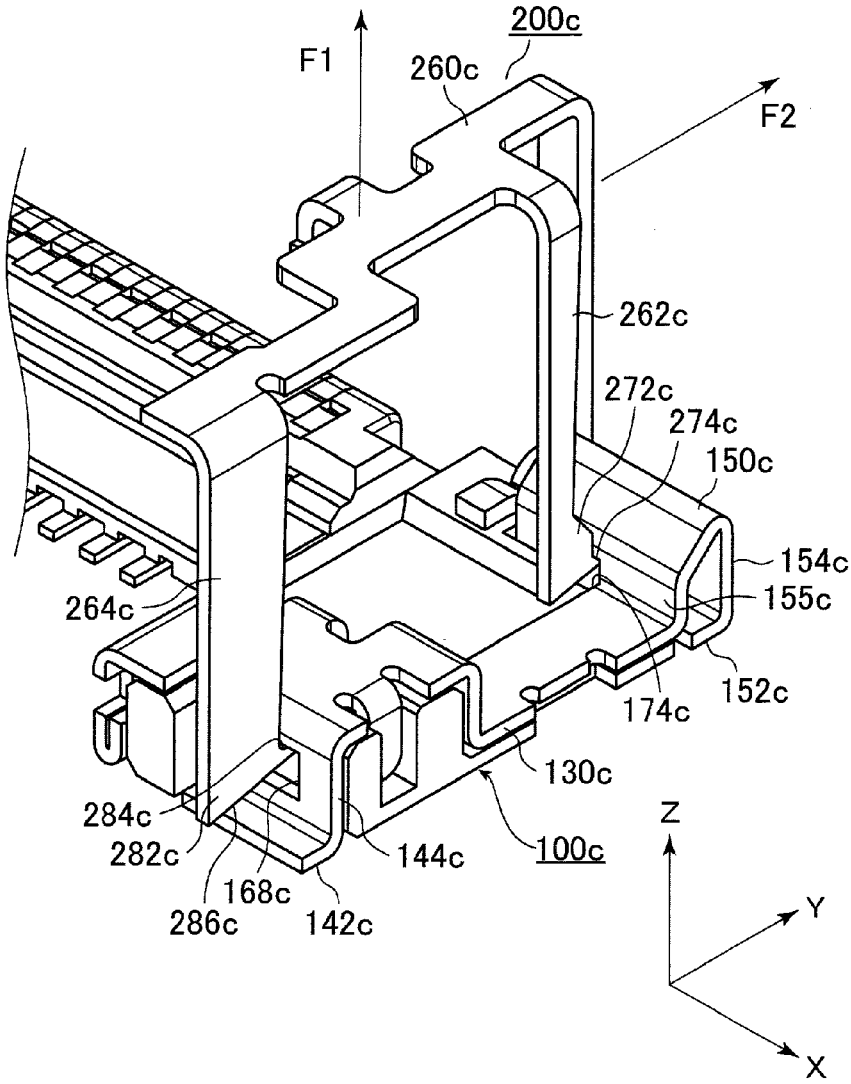
FIG. 16 is a partial, perspective view showing a locking member and a first shell of yet another modification of the connector assembly of FIG. 1.

As shown in FIG. 16, a connector assembly may comprise a first connector 100*c* and a second connector 200*c*. The first connector 100*c* includes a first shell 130*c*. The first shell 130*c* is formed with a hooked portion 174*c*. The second connector 200*c* includes a locking member 260*c*. The locking member 260*c* has a first hook portion 272*c* and a second hook portion 282*c*. Either the first hook portion 272*c* or the second hook portion 282*c* is configured to protrude only in the positive Y-direction (second horizontal direction). The first hook portion 272*c* and the second hook portion 282*c* have upper edges 274*c* and 284*c*, respectively. Either the upper edge 274*c* or 284*c* extends in the Y-direction. According to the present embodiment, the removing operation is able to be performed more easily when a force (F2 in FIG. 16) along the positive Y-direction is applied to an operating portion (not shown) of the second connector 200*c* than when a force (F1 in FIG. 16) along the positive Z-direction is applied to the operating portion. When a force along the negative Y-direction is applied to the operating portion, the upper edge 274*c* is brought into abutment with an upper surface of the hooked portion 174*c* so that the second connector 200*c* is prevented from being removed from the first connector 100*c*.

The present application is based on a Japanese patent application of J JP2010-150448 filed before the Japan Patent Office on Jun. 30, 2010, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising:

a first connector configured to be mounted on a connection object, the first connector including a first contact and a first holding member, the first holding member holding the first contact; and a second connector configured to be engaged with the first connector along a downward direction in a state where the first connector is positioned below the second connector, the second connector including a second contact, a second holding member, and an operating portion, the second holding member holding the second contact, the second contact being configured to be connected to the first contact under an engaged state where the second connector is engaged with the first connector, the operating portion being held by the second holding member so that a positional relation between the operating portion and the second holding member is kept when a force is applied to the operating portion along an upward direction and when a force is applied to the operating portion along a first horizontal direction perpendicular to the upward direction or a second horizontal direction opposite to the first horizontal direction, the second connector being removable from the first connector when a force is applied to the operating portion either along the upward direction or along the first horizontal direction or the second horizontal under the engaged state;

wherein:

the first contact has a first contact portion, the first contact portion protruding in the first horizontal direction from an upper part and a lower part of the first contact;

the second contact has an elastic support portion, a surmounting portion, and a second contact portion, the elastic support portion supporting the second contact portion and the surmounting portion elastically;

the elastic support portion presses the second contact portion against the first contact portion along the first horizontal direction under the engaged state so that the second contact portion is brought into contact with the first contact portion;

while the second connector moves to the engaged state from a state where the second connector is separated from the first connector, the surmounting portion is located below the second contact portion in the downward direction and surmounts the first contact portion; and the surmounting portion is located obliquely below the first contact portion under the engaged state so that the engaged state is maintained.

2. The connector assembly as recited in claim 1, wherein the second holding member covers the first holding member at least in the first horizontal direction and the second horizontal direction under the engaged state.

3. The connector assembly as recited in claim 1, wherein the second contact portion receives a reaction force from the first contact portion under the engaged state so that a part of the second holding member is pressed against the first holding member along the second horizontal direction.

4. The connector assembly as recited in claim 1, wherein:

the second connector further includes a locking member, the locking member being held by the second holding member and having at least one hook portion; and the first connector is formed with at least one hooked portion, the hook portion being hooked in the hooked portion under the engaged state so that the maintenance of the engaged state is secured.

5. The connector assembly as recited in claim 4, wherein:

the first connector has two of the hooked portions;

the locking member further has two hook support portions, the hook support portions extending in the downward direction; and the locking member has two of the hook portions, each of the hook portions having an upper edge and a lower edge, the upper edge and the lower edge extending in directions each oblique to the downward direction so that each of the hook portions has an acute triangle-like shape, the hook portions being held by the respective hook support portions so as to protrude toward each other, one of the hook portions protruding in the first horizontal direction, a remaining one of the hook portions protruding in the second horizontal direction, the hook support portions being configured to press the hook portions against the hooked portions under the engaged state, respectively.

6. The connector assembly as recited in claim 4, wherein the hook portion protrudes only in the second horizontal direction.

7. The connector assembly as recited in claim 1, further comprising a third connector configured to be engaged with the second connector, the third connector having a third contact, the third contact being connected to the second contact when the third connector is engaged with the second connector, wherein the second connector functions as an inter-connector which electrically connects the first contact of the first connector and the third contact of the third connector with each other.

8. The connector assembly as recited in claim 7, wherein:

the second holding member has an accommodating portion, the accommodating portion being configured to accommodate the third connector;

the second connector has a cover portion, the cover portion being fixed to the second holding member so that the cover portion is capable of covering a top surface of the third connector in a state where the third connector is accommodated within the accommodating portion; and the operating portion is formed on the cover portion.

9. The connector assembly as recited in claim 8, wherein:

the cover portion has two end portions in a predetermined direction perpendicular to the first horizontal direction;

one of the end portions is hinged to the second holding member;

a remaining one of the end portions is formed with a cover-side hooked portion;

the second holding member is formed with a holding-member-side hooked portion; and the cover-side hooked portion is hooked on the holding-member-side hooked portion so that the cover portion is fixed to the second holding member.

10. The connector assembly as recited in claim 1, wherein the operating portion is shaped so that the operating portion extends both in the upward direction and a predetermined direction which is perpendicular to the first horizontal direction.

11. The connector assembly as recited in claim 10, wherein the operating portion is formed with a hole, the hole piercing the operating portion along the first horizontal direction.

12. A connector assembly comprising:

a first connector configured to be mounted on a connection object, the first connector including a first contact and a first holding member, the first holding member holding the first contact; and a second connector configured to be engaged with the first connector along a downward direction in a state where the first connector is positioned below the second connector, the second connector including a second contact, a second holding member, and an operating portion, the second holding member holding the second contact, the second contact being configured to be connected to the first contact under an engaged state where the second connector is engaged with the first connector, the operating portion being held by the second holding member so that a positional relation between the operating portion and the second holding member is kept when a force is applied to the operating portion along an upward direction and when a force is applied to the operating portion along a first horizontal direction perpendicular to the upward direction or a second horizontal direction opposite to the first horizontal direction, the second connector being removable from the first connector when a force is applied to the operating portion either along the upward direction or along the first horizontal direction or the second horizontal under the engaged state;

wherein:

the first contact has a first contact portion;

the second contact has an elastic support portion, a surmounting portion, and a second contact portion, the elastic support portion supporting the second contact portion and the surmounting portion elastically;

the elastic support portion presses the second contact portion against the first contact portion along the first horizontal direction under the engaged state so that the second contact portion is brought into contact with the first contact portion;

while the second connector moves to the engaged state from a state where the second connector is separated from the first connector, the surmounting portion is located below the second contact portion in the downward direction and surmounts the first contact portion;

the surmounting portion is located obliquely below the first contact portion under the engaged state so that the engaged state is maintained;

the second connector further includes a locking member, the locking member being held by the second holding member and having at least one hook portion;

the first connector is formed with at least one hooked portion, the hook portion being hooked in the hooked portion under the engaged state so that the maintenance of the engaged state is secured;

the first connector has two of the hooked portions;

the locking member further has two hook support portions, the hook support portions extending in the downward direction; and the locking member has two of the hook portions, each of the hook portions having an upper edge and a lower edge, the upper edge and the lower edge extending in directions each oblique to the downward direction so that each hook portion has an acute triangle-like shape, the hook portions being held by the respective hook support portions so as to protrude toward each other, one of the hook portions protruding in the first horizontal direction, a remaining one of the hook portions protruding in the second horizontal direction, the hook support portions being configured to press the hook portions against the hooked portions under the engaged state, respectively.

13. A connector assembly comprising:

a first connector configured to be mounted on a connection object, the first connector including a first contact and a first holding member, the first holding member holding the first contact; and a second connector configured to be engaged with the first connector along a downward direction in a state where the first connector is positioned below the second connector, the second connector including a second contact, a second holding member, and an operating portion, the second holding member holding the second contact, the second contact being configured to be connected to the first contact under an engaged state where the second connector is engaged with the first connector, the operating portion being held by the second holding member so that a positional relation between the operating portion and the second holding member is kept when a force is applied to the operating portion along an upward direction and when a force is applied to the operating portion along a first horizontal direction perpendicular to the upward direction or a second horizontal direction opposite to the first horizontal direction, the second connector being removable from the first connector when a force is applied to the operating portion either along the upward direction or along the first horizontal direction or the second horizontal under the engaged state;

wherein the operating portion is shaped so that the operating portion extends both in the upward direction and a predetermined direction which is perpendicular to the first horizontal direction; and wherein the operating portion is formed with a hole, the hole piercing the operating portion along the first horizontal direction.

* * * * *

UNITED STATES PATENT AND TRADEMARK OFFICE

CERTIFICATE OF CORRECTION

PATENT NO. : 8,523,603 B2
APPLICATION NO. : 13/172089
DATED : September 3, 2013
INVENTOR(S) : Takahiro Yamaji et al.

It is certified that error appears in the above-identified patent and that said Letters Patent is hereby corrected as shown below:

In the Specification:

Column 1, line 67, after “horizontal” insert --direction--.

In the Claims:

Column 12, line 14 (Claim 1, line 26), after “horizontal” insert --direction--.

Column 14, line 6 (Claim 12, line 26), after “horizontal” insert --direction--.

Column 15, line 9 (Claim 13, line 26), after “horizontal” insert --direction--.

Signed and Sealed this
Eleventh Day of February, 2014

Michelle K. Lee

Michelle K. Lee
*Deputy Director of the United States Patent and Trademark Office*